US007581602B2

(12) United States Patent
Lorger et al.

(10) Patent No.: US 7,581,602 B2
(45) Date of Patent: Sep. 1, 2009

(54) DOWNHOLE HAMMER DRILL

(75) Inventors: Tony Lorger, Eagleby (AU); Daniel Paul Lorger, Rollingstone (AU); Sugavanum Ravichandra, Bangalore (IN)

(73) Assignee: Sparroc Drillco Services Pty Ltd, Eagleby, Queensland (AU)

( * ) Notice: Subject to any disclaimer, the term of this patent is extended or adjusted under 35 U.S.C. 154(b) by 88 days.

(21) Appl. No.: 10/565,640

(22) PCT Filed: Jul. 26, 2004

(86) PCT No.: PCT/AU2004/000998

§ 371 (c)(1),
(2), (4) Date: Jan. 24, 2006

(87) PCT Pub. No.: WO2005/010317

PCT Pub. Date: Feb. 3, 2005

(65) Prior Publication Data

US 2007/0007045 A1 Jan. 11, 2007

(30) Foreign Application Priority Data

Jul. 24, 2003 (AU) ..... 2003903831

(51) Int. Cl.
*E21B 10/38* (2006.01)

(52) U.S. Cl. ..... 175/296; 175/418

(58) Field of Classification Search ..... 175/296, 175/306, 417, 418

See application file for complete search history.

(56) References Cited

U.S. PATENT DOCUMENTS

| | | | | |
|---|---|---|---|---|
| 4,819,746 | A * | 4/1989 | Brown et al. | 175/296 |
| 5,139,096 | A * | 8/1992 | Lister | 175/92 |
| 5,407,021 | A * | 4/1995 | Kane et al. | 175/296 |
| 5,778,993 | A * | 7/1998 | Moir | 175/215 |
| 6,095,261 | A * | 8/2000 | Trevino, Jr. | 175/57 |
| 6,702,045 | B1 * | 3/2004 | Elsby | 175/93 |
| 2005/0199429 | A1 * | 9/2005 | Terlet et al. | 175/296 |

FOREIGN PATENT DOCUMENTS

| | | |
|---|---|---|
| GB | 2243387 | 10/1991 |
| WO | 88/03220 | 5/1988 |
| WO | 91/16521 | 10/1991 |

* cited by examiner

*Primary Examiner*—Shane Bomar
(74) *Attorney, Agent, or Firm*—Shoemaker and Mattare

(57) ABSTRACT

There is provided a down hole hammer having a drive sub or chuck (10) having splines (11), and a drill bit (13) having a bit shank (14) having longitudinal splines (23) extending toward a bit head (15) having a bit face (16) bounded by a series of gauge row mounting portions (17), each of which has a carbide button insert (20). The bit shank splines (23) cooperate with chuck splines (11) to rotate the bit (13), the respective splines (23), (11) being proportioned to allow hammer motor exhaust air to pass down the splines. Drillings (37) are drilled from the termination of the spline milling, through to intersect with fluid passage (33) extending from sample recovery bore (22) to the bit face (16). A bore seal (32) is formed by milling a plurality of circumferential grooves (36), fed by a plurality of transverse holes (35) intersecting the air passage (33). Fluid passage (33) may be altered to fine tune the airflow to suit specific ground conditions, by effecting a change in diameter at point (38). The chuck (10) is provided with bleed ports (40) which direct air up the borehole when the bit is in its extended position to reduce contamination at the bit face.

11 Claims, 11 Drawing Sheets

DOWNHOLE HAMMER DRILL

FIELD OF INVENTION

This invention relates to a down hole hammer drill.

This invention has particular application to a reverse-circulation down hole face sampling hammer drill, and for illustrative purposes, reference will be made to this application. However, it is envisaged that this invention may find application in other forms of drilling apparatus, such as reverse circulation tricone drills.

PRIOR ART

In the operation of sampling hammers it is understood that sampling integrity is improved if the hammer exhaust air is used to flush cuttings is directed toward the face of the bit. By this means, chips are entrained at the point of their production. In Australian Patent Numbers 638571 and 656724, there are disclosed face sampling reverse circulation downhole hammers including a shroud, or sleeve, that extends beyond the lower end of the chuck or drive sub, to surround the head of the bit, which is relieved to accommodate the sleeve or shroud.

The shroud or sleeve cooperates with air passages down the side of the bit head to direct air toward the cutting face of the bit. Air exhausted from the hammer free-piston motor passes down the splines that engage the bit for rotation and reciprocation in the chuck or drive sub. Air exits the lower end of the shroud or sleeve through the air passaging grooves in the side of the bit head, to pass substantially to and across the cutting face of the bit.

Chippings are entrained in the air stream and conducted to the surface through sample apertures in the bit cutting face communicating with a sample recovery conduit comprising an axial passage defined through the hammer to the inner tube of a dual wall drill string.

The shroud or sleeve is selected to be of substantially the same diameter as the gauge row of carbides of the bit head, and of greater diameter than the hammer casing, in order to provide a partial seal between the borehole and the hammer to constrain air to the cutting face of the bit and to thus substantially reduce both blowby of exhaust air and contamination of the sample from above.

The prior art hammers described above rely on the bit head itself to provide one wall of the conduits or passages conveying air towards the cutting face of the bit. The bit must necessarily run at a clearance from the sleeve, and the bit head necessarily oscillates relative to the sleeve. As a result of this, combined with the fact that the shroud or sleeve must stop well short of the cutting face to allow sufficient bit head metal to remain to support the gauge row, the air exiting the passages is not fully directed downward towards the cutting face through the grooves in the bit head exclusively. The exiting air also describes an outwardly expanding path from the passages, to be constrained by the borehole and turned across the cutting face of the bit. In tests it has been determined that the divergence from the vertical direction of the airflow is between 30 to 40 degrees included angle.

In a further prior art hammers, an extended lower bearing surface on the bit shank cooperates with a bore in the lower end of the drive sub. The bore is relieved with four lenticular section cut-outs to provide for egress of exhaust air, the cut-outs being indexed to respective grooves down the side of the bit head. The bit head is shortened to bring the egress point closer to the face of the bit. This embodiment may be termed a sleeved sub/short bit head type. Again, the bearing surface oscillates relative to the bore and the cut-outs, well short of the cutting face to allow sufficient bit head metal to remain to support the gauge row. Accordingly, the air exiting the passages is not fully directed downward towards the cutting face through the grooves in the bit head exclusively. The exiting air also describes an outwardly expanding path from the passages, to be constrained by the borehole and turned across the cutting face of the bit.

In soft ground, the turbulence and expansion of air exhausted from prior art hammers tends to scour the borehole such that the hole is significantly larger than the gauge sleeve. This in turn causes loss of seal resulting in loss of sample up the borehole. As air velocity up the sample recovery conduit is lost through blowing by the seal, there is an increased tendency of the conduit to block, particularly at the sample return holes in the drill bit.

In WO01/21930 there is provided drilling apparatus including a chuck, a drill bit supported in the chuck and having a bit head extending below the chuck, the bit head having longitudinal air channels defined down the outside of the bit and extending through the cutting face, a gauge sleeve secured in relation to said chuck, and air passages defined between the gauge sleeve and the chuck having a terminal portion extending substantially parallel to the axis of the drill bit and substantially in register with the air channels. This construction again has the disadvantage of the air diverging from the lower end of the channels over the length of the bit head, tending to scour the bore hole at the cutting face level.

DESCRIPTION OF THE INVENTION

In one aspect the present invention relates to a downhole hammer drill including:

a drive sub or chuck mounted on an air hammer casing; and a reverse circulation drill bit having a bit shank mounted in splined relation to said drive sub or chuck and a bit head adapted to extend below said chuck, the air hammer motor exhausting down the splines, an annular groove in said bit shank adjacent said bit head and extending to intersect the lower end of the bit shank splines, a sleeve secured to said bit shank over the lower end of said bit shank splines and substantially closing over said groove to form a manifold for exhaust air exiting said splines, an upper air passage directing sample accelerating air from said manifold up the sample recovery bore of said bit, said bit head having at least one lower air passage therethrough and intersecting said manifold, said lower air passage having a lower end directing air to the cutting face of the bit through an outlet through the side of the bit head adjacent the gauge row thereof communicating with a channel passing from said outlet to said cutting face.

The chuck may be of any suitable form. For example, the chuck may comprise the type associated in the DTH hammer art as a drive sub, or alternatively may comprise the variant known as a SAMPLEX chuck. The chuck may be secured to the hammer casing by any suitable means.

The splines may be of a typical form, where the splines are milled, the milling tool advancing the spline toward the bit head and stopping short of the bit head to avoid the milling tool from removing bit head material. The groove may be formed by milling or turning. Typically there will be a progressive change of section between the splined portion of the bit shank and the bit head to avoid stress concentration. For example, the bit may be formed with two changes of section between the shank proper and the bit head. The groove may advantageously follow the profile of the change in section to retain the resistance to stress concentration.

The sleeve may in turn have an inner bore that is substantially cylindrical to engage the shank over the lower end portion of the splines, and may have a section that parallels the bottom surface of the groove to provide a manifold of substantially rectangular and thus maximised section. The sleeve may be an interference fit on the splines. The sleeve may be shrunk onto the splines. The sleeve may be retained by mechanical means such as threading, the threads on the bit shank being advantageously formed before milling of the splines. The sleeve may be adapted to slide in tolerance with a counterbored portion of the drive sub or chuck. In this case, the roll pin or the like may be retained by the drive sub.

The sleeve may be adapted to cyclically open a port in the chuck sidewall to allow exhaust air to escape up the outside of the drill string to clear fines from the borehole.

The at least one lower air passage defined between the sample recovery bore and the side of the bit head adjacent the gauge row is preferably one air passage for each carbide in the gauge row, the material of the bit head being relieved between the portions supporting the gauge row buttons to form the grooves, allowing the flushing air to pass to the face of the bit, entraining sample for recovery. The lower air passage is preferably formed by straight drilling at an angle to the drill bit axis from the side of the bit head adjacent the gauge row and extending to the sample recovery bore above the bit head, the straight drilling preferably intersecting the groove over the maximum section of the groove. By this means a single drilling provides both the lower air passage and the upper air passage in a single operation.

The bit head may be provided with other ports into the lower air passage for specific purposes. For example, there may be provided a passage from the lower air passage to the side of the bit head at its maximum diameter to provide an air seal against the borehole.

The upper air passage serves to accelerate recovered sample up the drill string and further serves to reduce the pressure at the cutting face of the bit. In doing so, the back-pressure sensed by the air motor is reduced, increasing efficiency of operation of the air motor.

Accordingly, in a further aspect the present invention relates to a downhole hammer drill including:

a drive sub or chuck mounted on an air hammer drill casing; and a reverse circulation drill bit having a bit shank mounted in splined relation to said drive sub or chuck and a bit head adapted to extend below said chuck, the air hammer motor exhausting down the splines, at least one upper air passage opening from the splines in the region of the bit head and inclined toward the axis of the bit away from said bit head, said air passage directing sample accelerating air from said opening up the sample recovery bore of said bit.

The spline-borne exhaust air may also be directed through the bit head by at least one lower air passage therethrough and intersecting the splines. For example, there may be provided a lower air passage having a lower end directing air to the cutting face of the bit through an outlet through the side of the bit head adjacent the gauge row thereof communicating with a channel passing from the outlet to the cutting face. The lower air passage may be formed as a continuation of the drilling of the upper air passage or may be formed separately.

Alternatively, the upper air passage and lower air passage may be co-formed by a drilling from the gauge row at the location of the button, through the bit head and into the shank, to intersect the sample recover bore as above. The drilling may be counter bored at its lower end to form the carbide button mounting socket. By this means the lower air passage is effectively blanked off at its lower end by the carbide button. In certain applications a substantial portion of the exhaust air flow is thus directed into the sample recovery bore. The direction of some air to the cutting face of the bit, provision of dynamic air seals to the borehole and other air utilization as previously described in the art may be provided by tapping into the air passage as desired. In certain embodiments the drive sub and bit shank may cooperate to operate as an effective slide valve to periodically admit some exhaust air to means directing air to the cutting face of the bit.

In a yet further aspect, the present invention relates to a downhole hammer drill including:

a drive sub or chuck mounted on an air hammer drill casing; and a reverse circulation drill bit having a bit shank mounted in splined relation to said drive sub or chuck and a bit head adapted to extend below said chuck, the air hammer motor exhausting down the splines, an exhaust air passage formed in said bit shank adjacent said bit head and adapted to receive air exhausted at the lower end of the bit shank splines, an upper air passage intersecting said exhaust air passage and directing sample accelerating air from said exhaust air passage up the sample recovery bore of said bit, said bit head having at least one lower air passage therethrough and intersecting said exhaust air passage, said lower air passage having a lower end directing air to the cutting face of the bit through an outlet through the side of the bit head adjacent the gauge row thereof communicating with a channel passing from said outlet to said cutting face.

BRIEF DESCRIPTION OF THE DRAWINGS

In order that this invention may be more readily understood and put into practical effect, reference will now be made to the accompanying drawings which illustrate a preferred embodiment of the invention and wherein.

DESCRIPTION OF THE PREFERRED EMBODIMENTS

Figure 1:
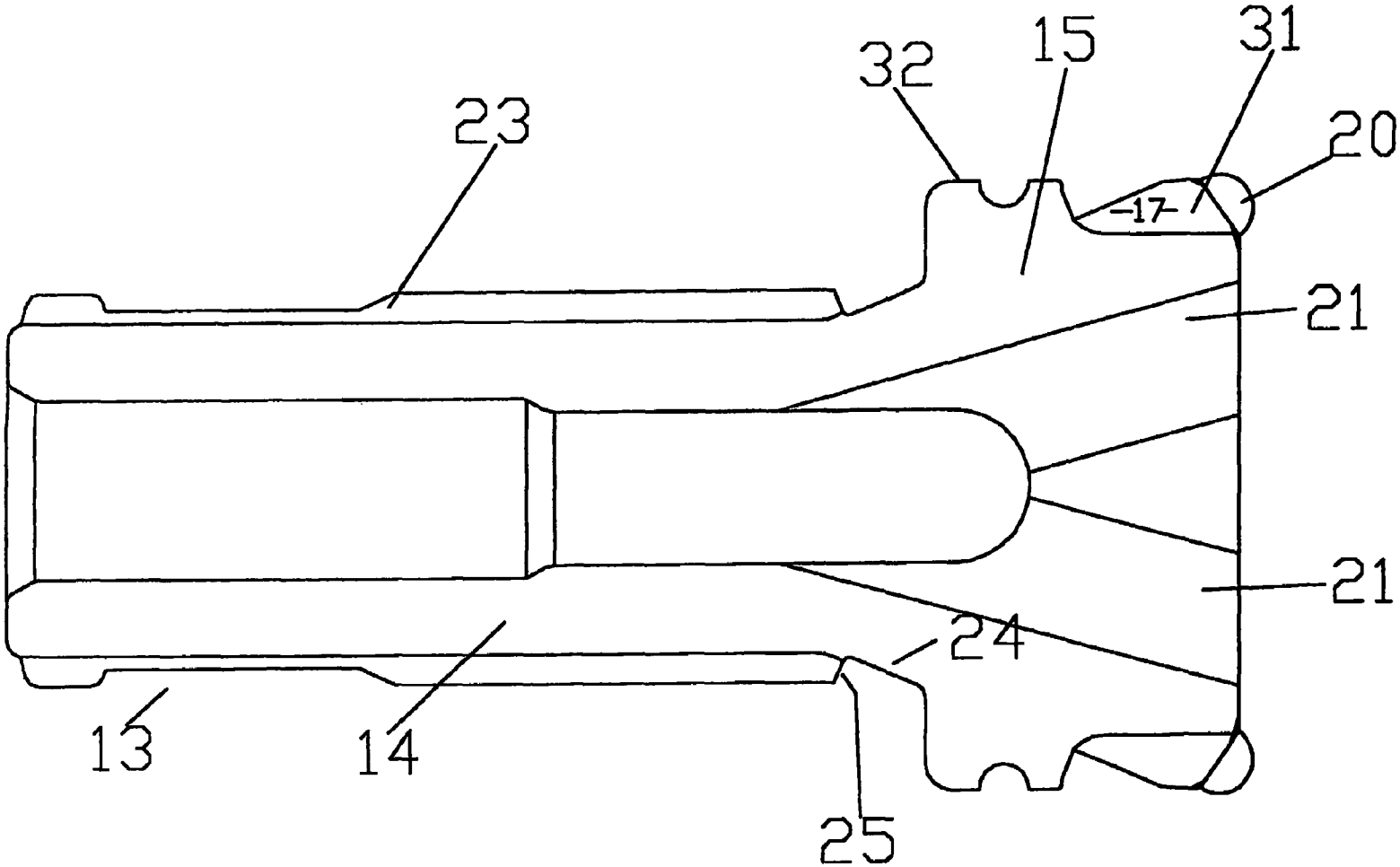
FIGS. 1 to 5 are a progression of sections through a bit assembly as it is developed in manufacture to form a hammer drill assembly in accordance with a first embodiment of the present invention.
Figure 2:
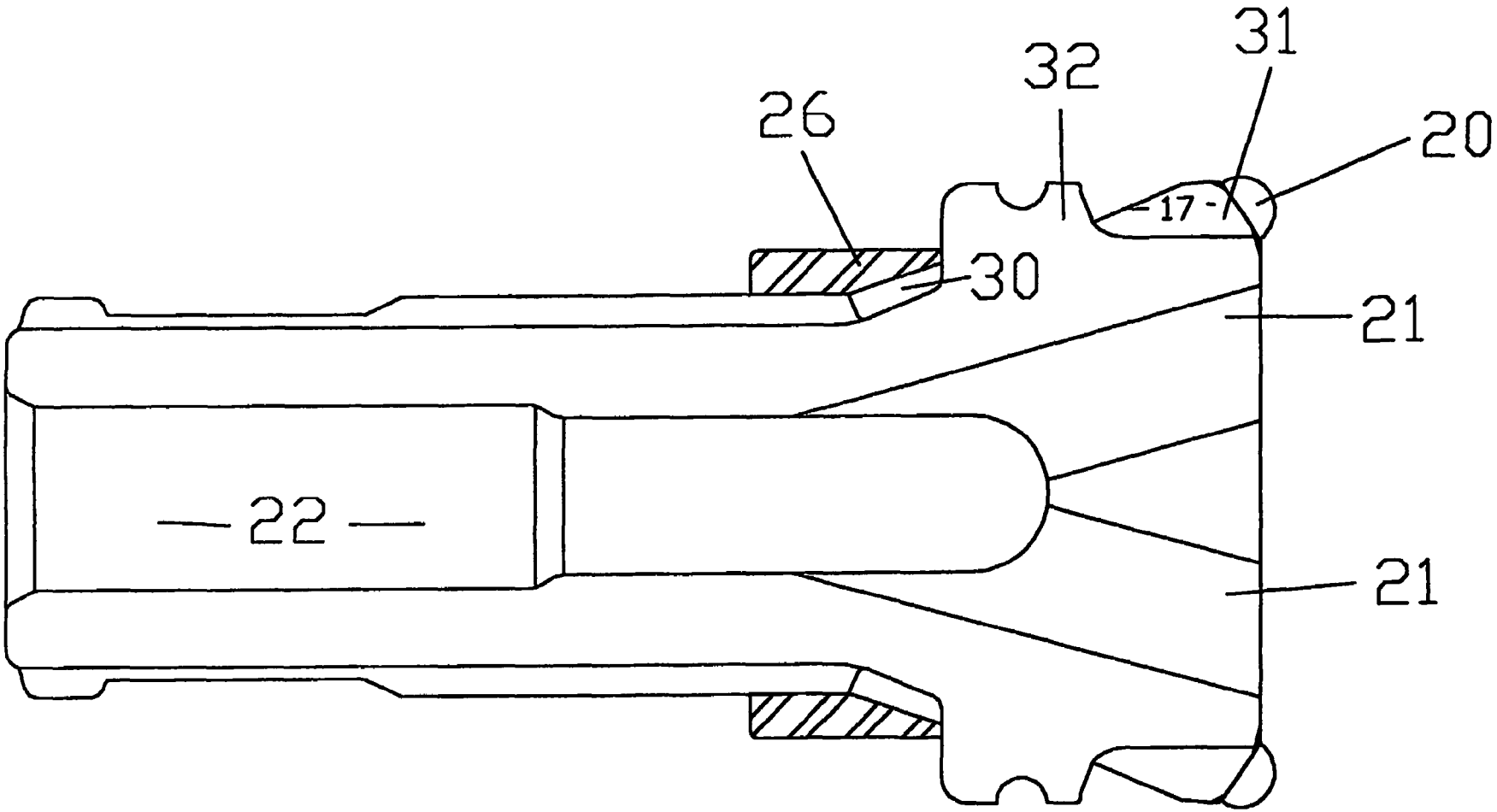
Figure 3:
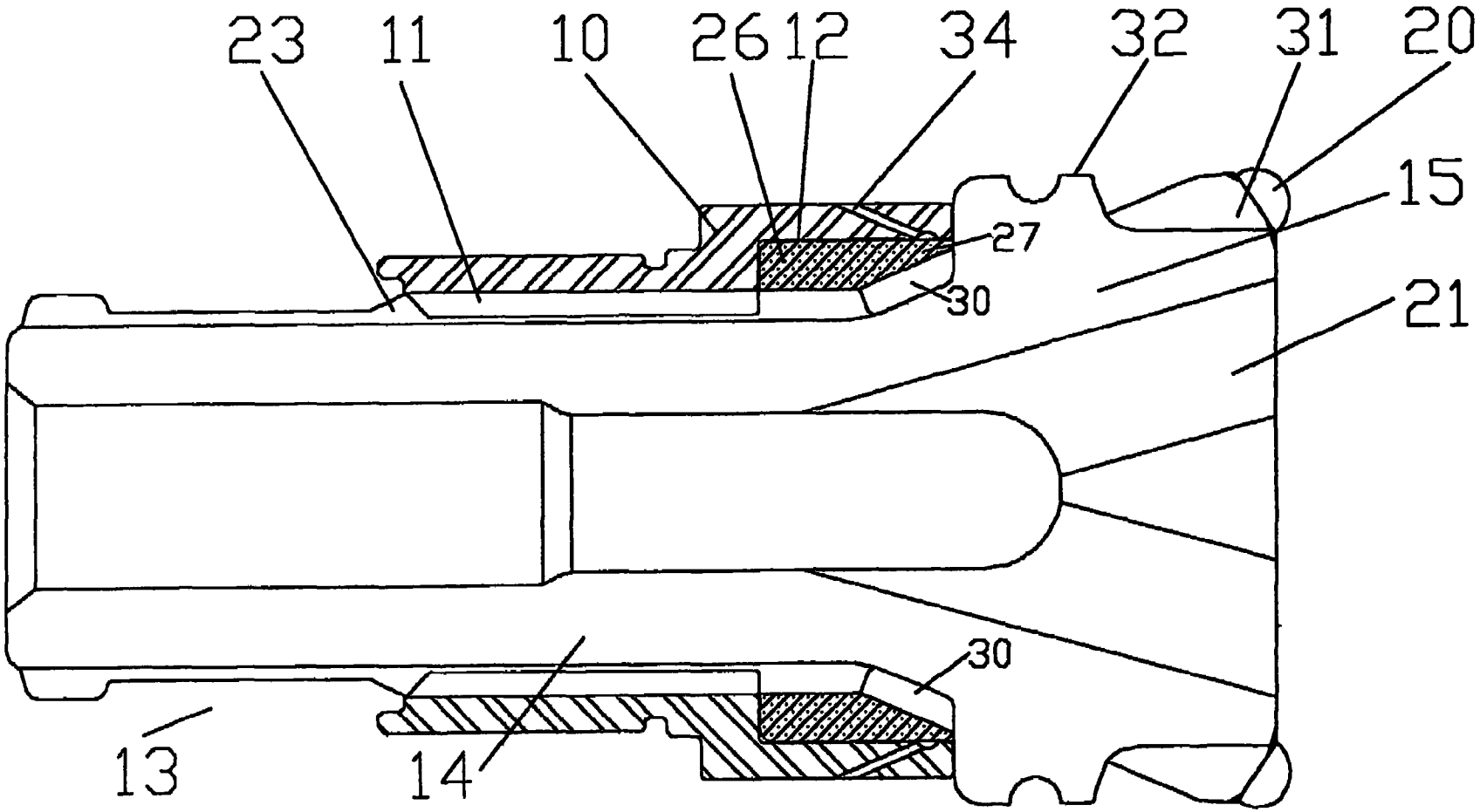
Figure 4:
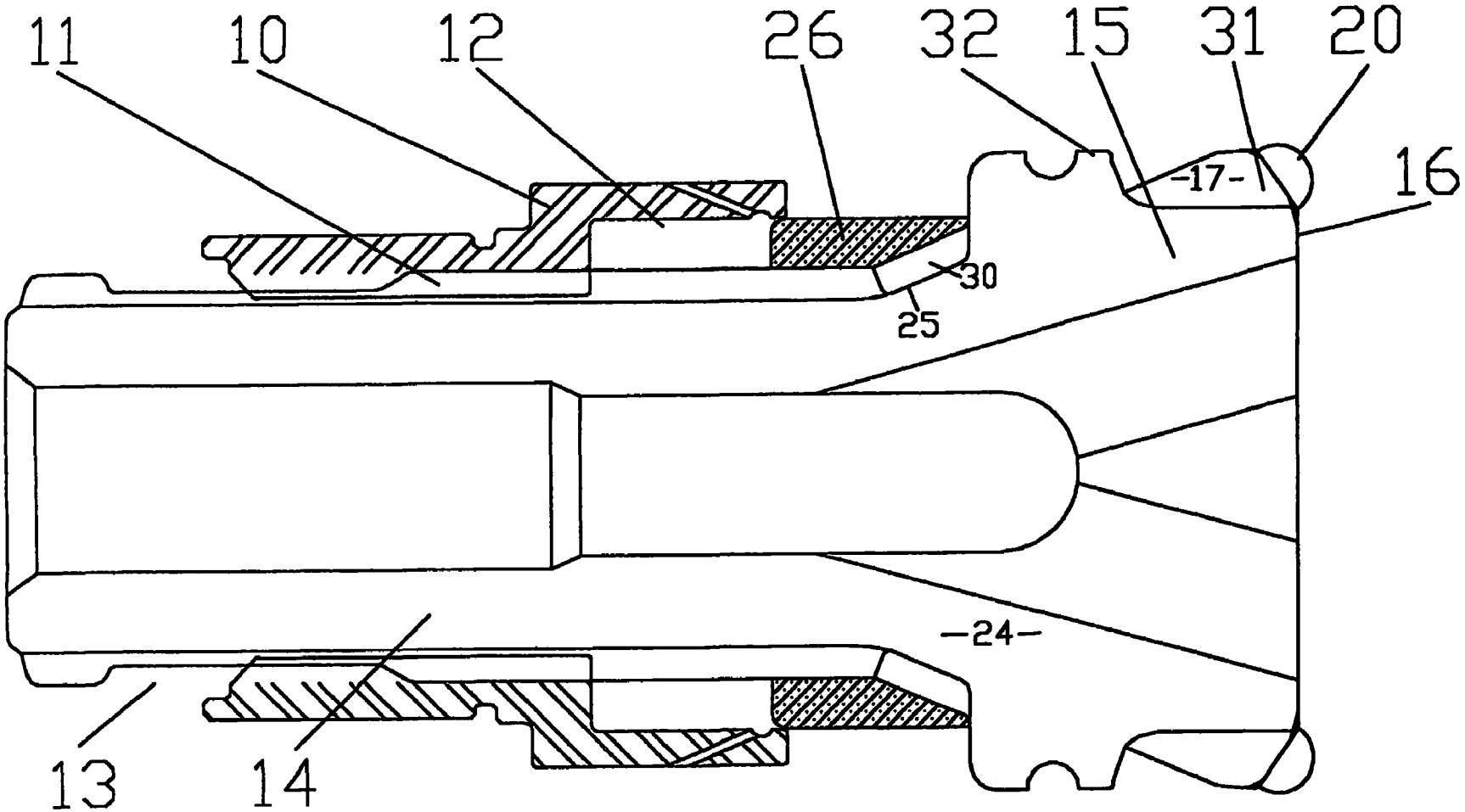
Figure 5:
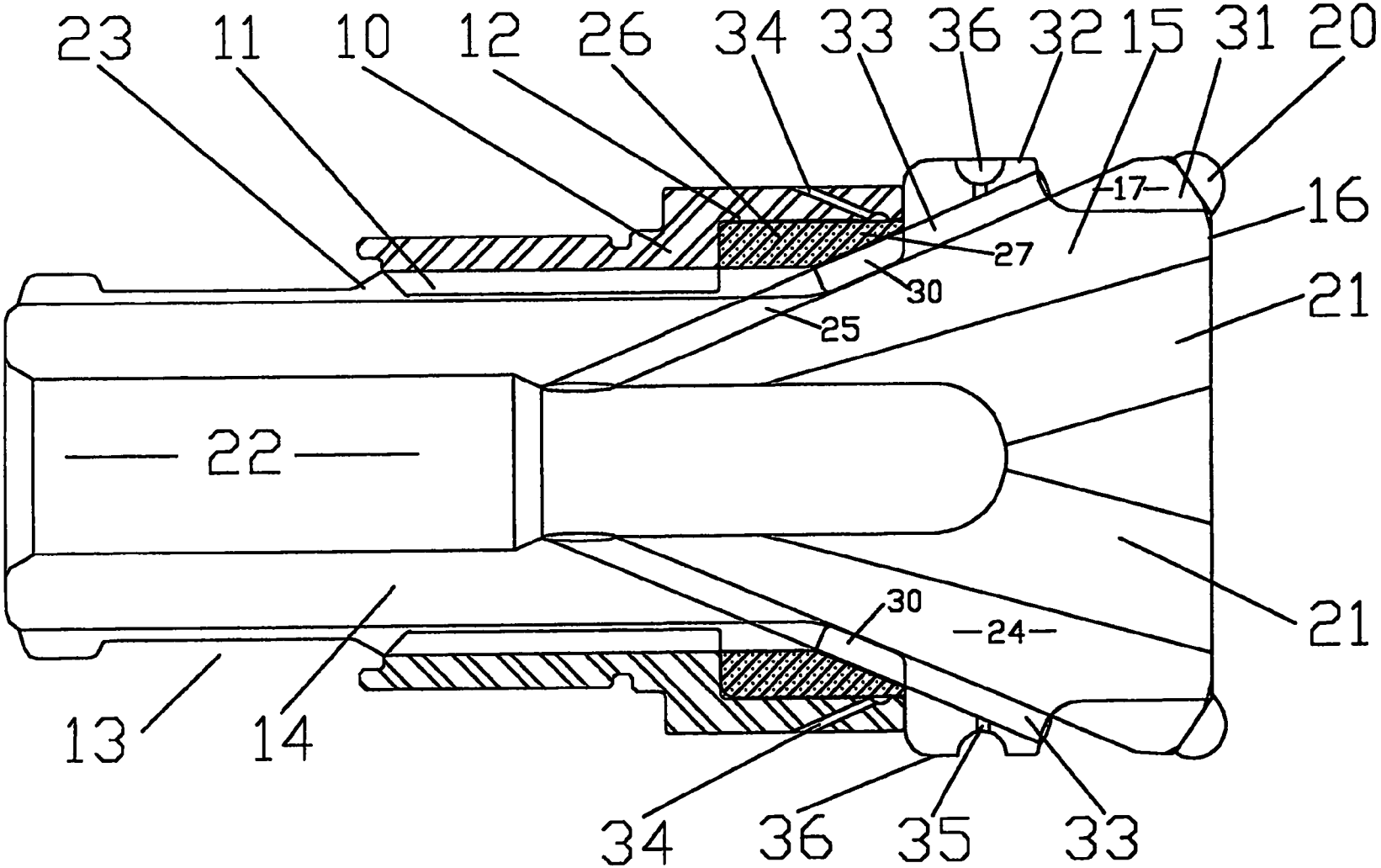

In the FIGS. 1 to 5 (and illustrated in final form in FIG. 5) there is provided a drive sub of chuck 10 having splines 11 and a counter bored portion 12. Mounted for reciprocation in the chuck 10 is a drill bit 13 having a bit shank 14 and a bit head 15. The bit head 15 has a bit face 16 bounded by a series of gauge row mounting portions 17, each of which has a carbide button insert 20, the carbide button insert 20 forming the gauge row. A pair of sample recovery passages 21 opens into the face 16 and are siamesed into an axial sample recovery bore 22 through the drill bit and allowing recovered sample to pass ultimately into the inner bore of a dual-wall drill string mounting the hammer (not shown).

The bit shank 14 has longitudinal splines 23 milled in its surface and extending toward a change of section 24 turning into the bit head 15. The bit shank splines 23 cooperate with chuck splines 11 to rotate the bit 13 while enabling the hammer to reciprocate the bit in the chuck 10. The respective splines 23, 11 are proportioned to allow hammer motor exhaust air to pass down the splines.

The bit shank splines 23 have their ends turned off by turning or milling of a groove 25 at the change of section 24. A sleeve 26 is fitted over the bit shank splines 23 and extends to the bit head 15. The sleeve 26 has a tapered bore 27 at the portion overlaying the groove 25, the turning or milling of the groove and the taper of the bore cooperating in use whereby a substantially rectangular-sectioned, annular air manifold 30 is formed by the groove 25, tapered bore 27 and shoulder of the bit head 15.

A channel 31 is formed on the outside of the bit head and, starting from the spaces between respective buttons 20 in the gauge row, extending from the face of the bit 16 to a portion 32 of the bit head of maximum diameter.

An air passage 33 is drilled from the inner end of each channel 31 at an angle to the bit axis to intersect the air manifold 30. The air passage drilling is extended through the opposite side of the air manifold to continue on to intersect the sample recovery bore 22, whereby exhaust air may pass both to the channel and the sample recovery bore, the angle to the axis of the bit ensuring that the air entering the sample recovery bore is directed up the drill string.

The outer surface of the sleeve 26 is a close sliding fit in the counter bored portion 12 of the chuck 10 and forms therewith a slide valve for a port 34 through the chuck wall and angled toward the drill string. The port 34 is opened to exhaust air at maximum extension of the bit to allow exhaust air to flush the borehole around the drill string.

The portion 32 of the bit head of maximum diameter is provided with transverse drillings 35 intersecting the air passages 33 and exiting the bit head at chambers 36. Air passing from the air passage 33 to the chambers 36 forms an air seal with the borehole preventing material from passing from the borehole above the bit to the cutting face 16, reducing sample contamination from the strata above the cutting face.

Figure 6A:
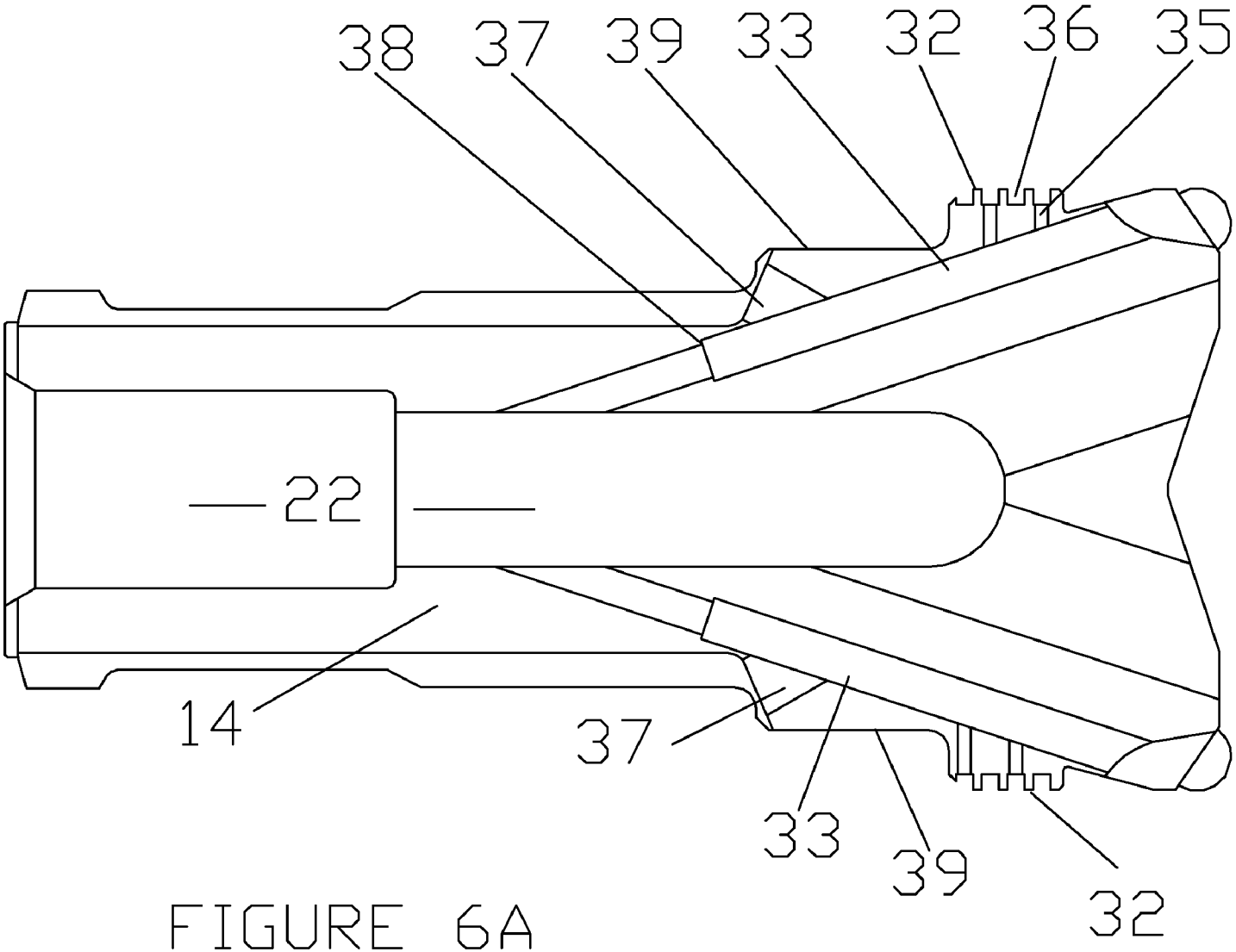
FIGS. 6A to 6C is an alternative drill assembly in accordance with the present invention.
Figure 6B:
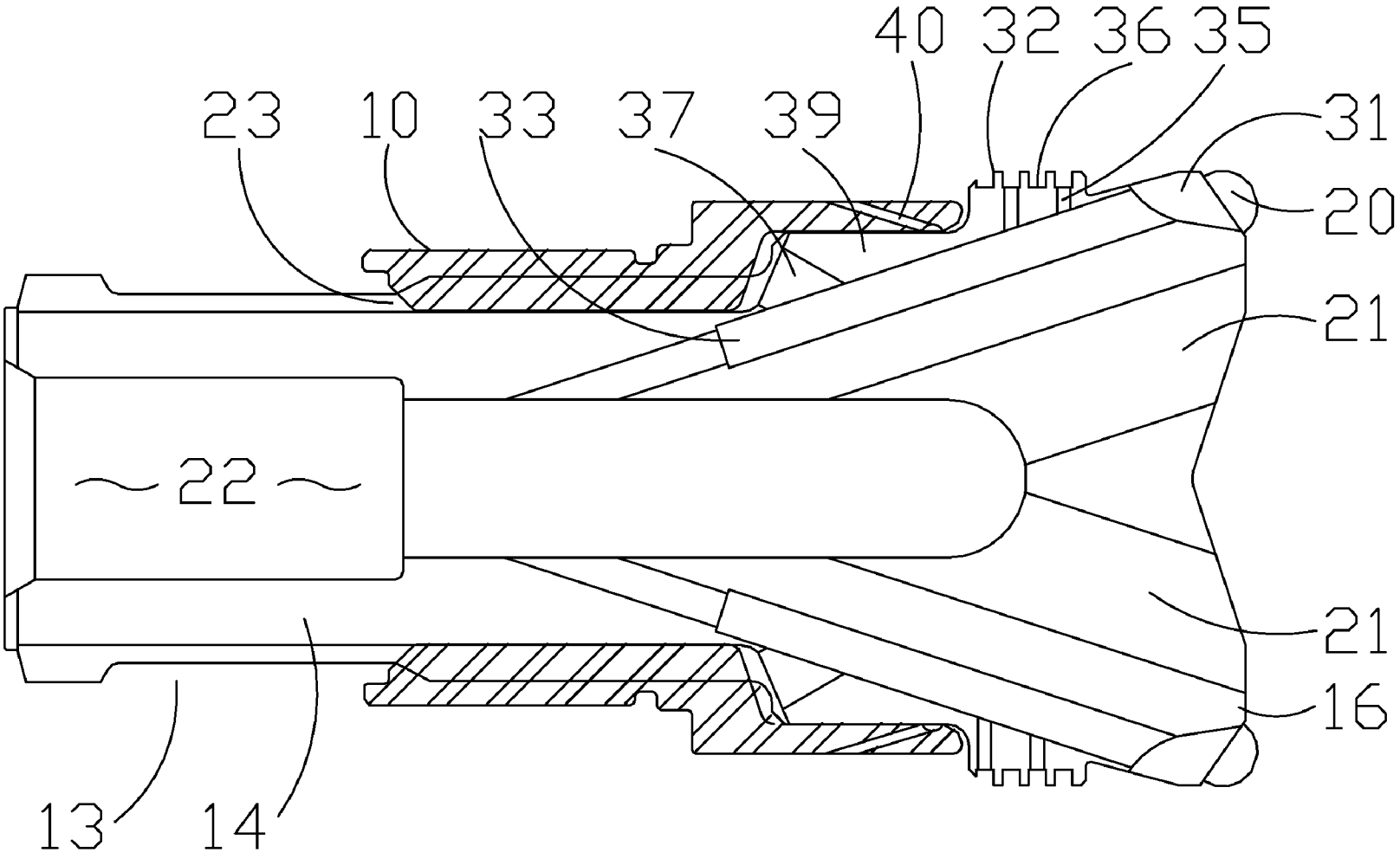
Figure 6C:
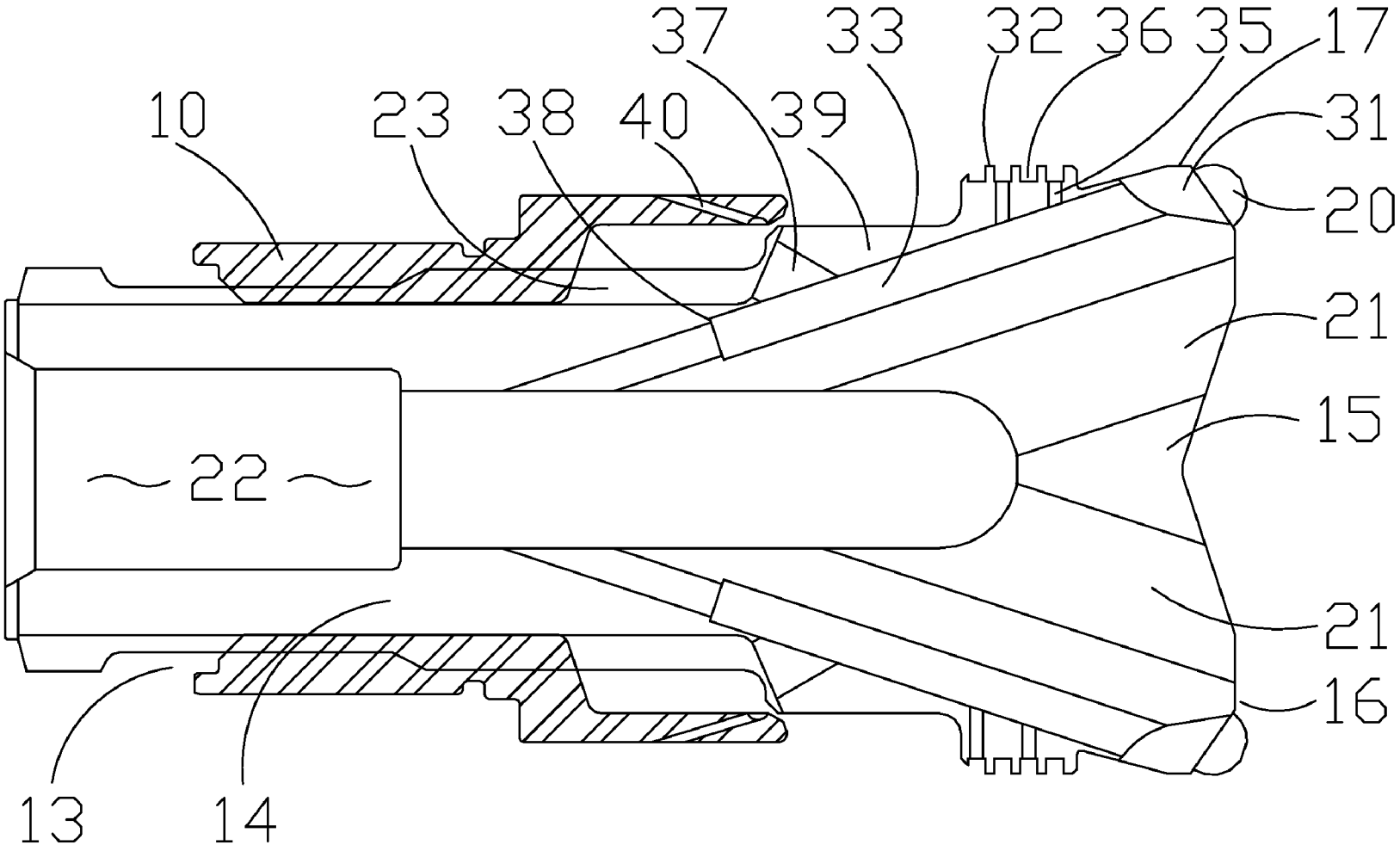

In the embodiment of FIGS. 6A to 6C, like numerals indicate features common with the embodiment of FIGS. 1 to 5. There is provided a drive sub or chuck 10 having splines 11 and a counter bored portion 12. Mounted for reciprocation in the chuck 10 is a drill bit 13 having a bit shank 14 and a bit head 15. The bit head 15 has a bit face 16 bounded by a series of gauge row mounting portions 17, each of which has a carbide button insert 20, the carbide button insert 20 forming the gauge row. A pair of sample recovery passages 21 opens into the face 16 and are siamesed into an axial sample recovery bore 22 through the drill bit and allowing recovered sample to pass ultimately into the inner bore of a dual-wall drill string mounting the hammer (not shown).

The bit shank 14 has longitudinal splines 23 milled in its surface and extending toward the bit head 15. The bit shank splines 23 cooperate with chuck splines 11 to rotate the bit 13 while enabling the hammer to reciprocate the bit in the chuck 10. The respective splines 23, 11 are proportioned to allow hammer motor exhaust air to pass down the splines.

In lieu of the machining of a continuous annular land to be closed over by a separate sleeve to form a manifold, the splines 23 are formed up to the bit shoulder 39, the shoulder 39 being turned down relative to the diameter of the bit head proper to form a seal land, the purpose of which will become apparent hereinafter. Drillings 37 drilled from the termination of the spline milling, through to intersect with fluid passage 33 extending from sample recovery bore 22 to channel 31, and thence to the bit face 16.

The seal land formed by the bit shoulder 39 is homogenous with bit 14 and fluid flow transfer is effected by intersection of holes 37 with fluid passage 33. A bore seal 32 is formed by milling annular chambers 36 to form a plurality of circumferential grooves, either individually or cut helically to form a continuous spiral groove, thereby imparting a labyrinth effect, forming multiple chambers 36, fed by a plurality of transverse holes 35 intersecting the air passage 33.

Fluid passage 33 may be altered in diameter at point 38, for the purpose of providing a means of altering the air/fluid flow balance between upper and lower ends, also by means of insertion of plugs, either blank or having an orifice therethrough and functioning as a choke. This makes it possible to fine tune the airflow to suit specific ground conditions.

The chuck 10 is adapted to pass over the bit shoulder 39 when the bit is closed up to the chuck. The chuck 10 is provided with bleed ports 40 which direct air up the borehole when the bit is in its extended position to reduce contamination at the bit face from material falling down the borehole.

In the embodiments of the invention of FIGS. 7A to D, these have relevance to the need in some parts of the drilling industry, for example environmental sampling, or drilling in an environmentally sensitive area where no residue from the ground drilling process is permitted, and/or minimum ground disturbance is required, whereby the bit is manufactured in such a fashion as to permit no pressurised air escaping to the bit face directly, but directing it through the fluid passage 33 to sample recovery bore 22, thereby creating a low/negative pressure zone at the sample recovery bore/s 21, drawing airflow, down the borehole from the surface, or from introduced exhaust air metered from the shoulder 39 of the bit, as desired. In which case it is envisioned the bore seal 32 may not be required.

Figure 7B:
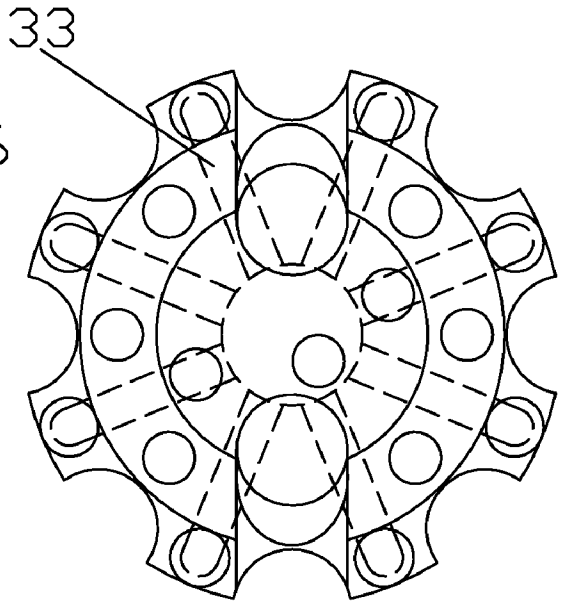
FIGS. 7A and 7B are a section and an end view respectively of an alternative bit in accordance with the present invention.
Figure 7A:
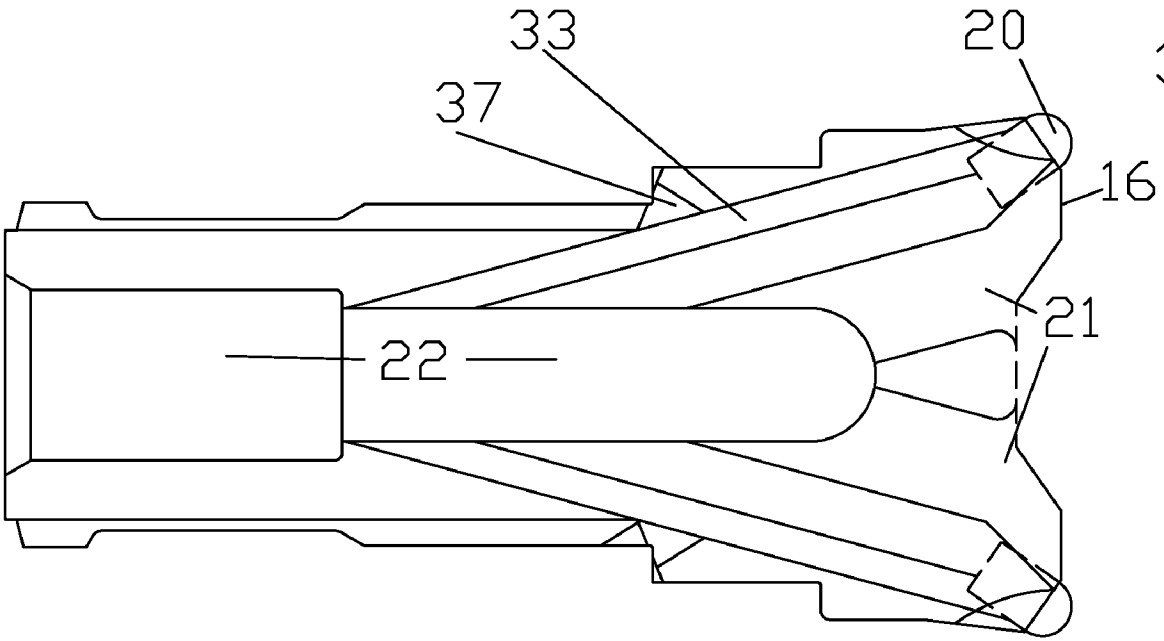

FIGS. 7A and 7B demonstrate the method by which fluid flow in passage 33 is directed wholly toward sample bore 22 by means of utilising the carbide cutter 20 as a plug. This method allows the flexibility of being able to drill passages intersecting the lower end of passage 33, from channel 31 or bit face 16, thereby angularly directing flushing fluid most effectively.

Figure 7D:
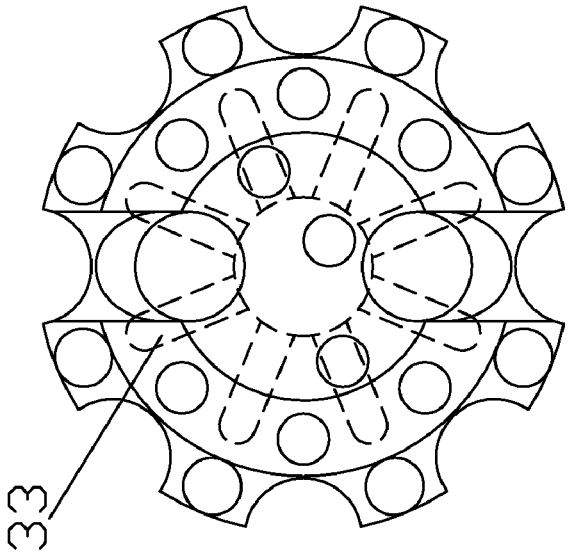
FIGS. 7C and 7D are a section and an end view respectively of an alternative bit in accordance with the present invention.
Figure 7C:
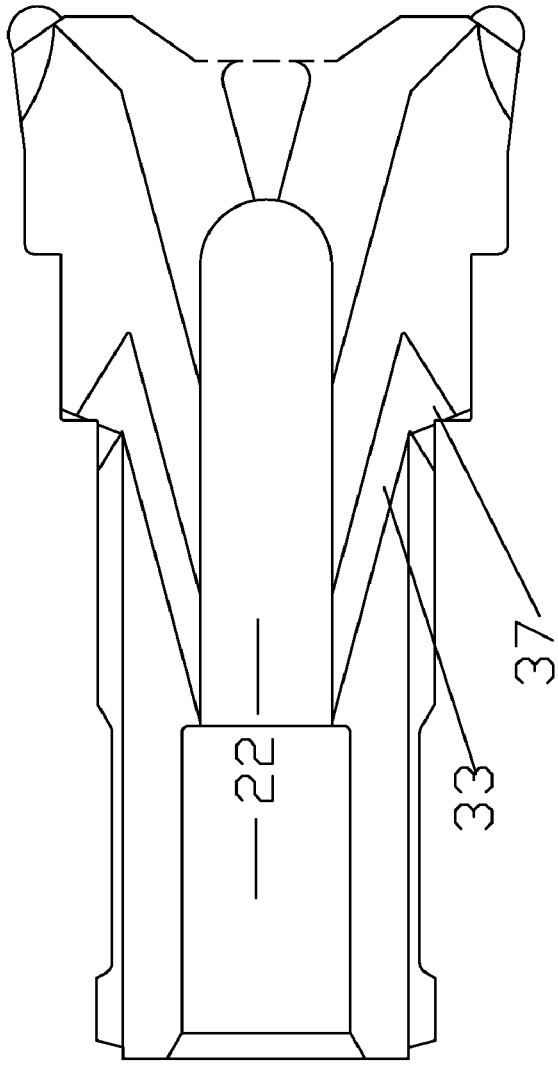

FIGS. 7C and 7D provide that the air passage 33 does not extend from the bit face at the gauge row at all, the passage 33 being drilled from the sample tube end of the bit to intersect the drillings 37.

Figure 8:
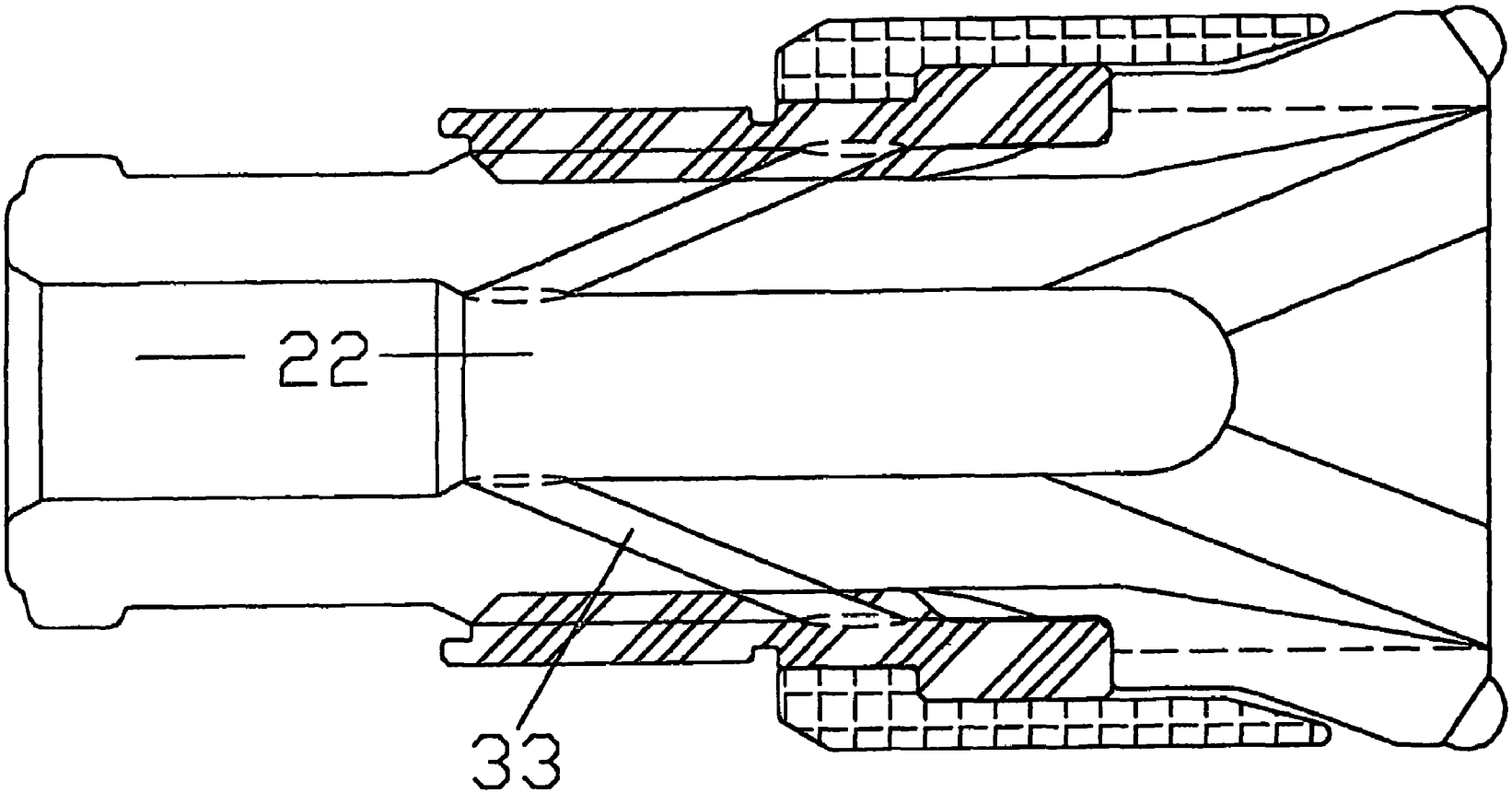
FIG. 8 is a section of an alternative drill assembly in accordance with the present invention.

In the embodiment of FIG. 8, there is illustrated an embodiment of the invention whereby the fluid passages 33 intersecting sample recovery bore 22 would advantageously benefit a conventional prior art annular sleeve system.

Apparatus in accordance with the foregoing embodiments have the advantages of being simple in construction while providing efficient air management and sample recovery. The directing of a proportion of the exhaust air up the sample recovery bore tends to reduce the air pressure and volume of flow at the cutting face, reducing bore hole scouring. Reducing the face pressure also reduces the backpressure, resulting in improved air motor efficiency, since the efficiency of an air motor in increases with the pressure difference between the air supply and the exhaust back pressure.

It will of course be realised that while the above has been given by way of illustrative example of this invention, all such and other modifications and variations thereto as would be apparent to persons skilled in the art are deemed to fall within the broad scope and ambit of this invention as described herein.

The invention claimed is:

1. A downhole hammer drill including:

a drive sub or chuck mounted on an air hammer drill casing; and a reverse circulation drill bit having a bit shank mounted in splined relation to said drive sub or chuck and a bit head adapted to extend below said drive sub or chuck, an air hammer motor in the air hammer drill casing, said motor exhausting air down the splines, and a plurality of upper air passages each opening from a spline in the region of the bit head and each inclined toward the axis of the bit and extending along the bit shank away from said bit head to intersect a sample recovery bore of said bit, said upper air passages being configured to direct substantially all of the air from the air passages opening from said splines as sample accelerating air up the sample recovery bore.

2. A downhole hammer drill according to claim 1, wherein spline-borne exhaust air is also directed through the bit head by at least one lower air passage therethrough.

3. A downhole hammer drill according to claim 2, wherein said at least one lower air passage has a lower end directing air to the cutting face of the bit through an outlet through the side of the bit head adjacent a gauge row thereof and communicating with a channel passing from the outlet to the cutting face.

4. A downhole hammer drill according to claim 3, wherein said at least one lower air passage is a continuation of each of the upper air passages.

5. A downhole hammer drill according to claim 4, wherein each said upper air passage and lower air passage are co-formed by a drilling from the gauge row at the location of the button, through the bit head and into the shank, to intersect the sample recovery bore.

6. A downhole hammer drill according to claim 1, wherein each said upper air passage is formed by a drilling from the position of a gauge row at the location of a carbide button, through the bit head and into the shank, to intersect the sample recovery bore, and wherein said drilling is counter bored at its lower end to form the carbide button mounting socket.

7. A downhole hammer drill according to claim 1, further comprising a dynamic air seal to a borehole formed by the downhole hammer drill in use.

8. A downhole hammer drill including:

a drive sub or chuck mounted on an air hammer drill casing; and a reverse circulation drill bit having a bit shank mounted in splined relation to said drive sub or chuck and a bit head adapted to extend below said chuck, an air hammer motor exhausting down the splines, an exhaust air passage formed in said bit shank adjacent said bit head and adapted to receive air exhausted at the lower end of the bit shank splines, an upper air passage opening from said exhaust air passage in the region of the bit head and inclined toward the axis of the bit and extending along the bit shank away from said bit head to intersect a sample recovery bore of said bit, said upper air passage being configured to direct substantially all of the sample accelerating air from the said exhaust air passage up the sample recovery bore, said bit head having at least one lower air passage therethrough and intersecting said exhaust air passage, said lower air passage having a lower end directing air to the cutting face of the bit through an outlet through the side of the bit head adjacent a gauge row thereof communicating with a channel passing from said outlet to said cutting face.

9. A downhole hammer drill according to claim 8, further comprising a dynamic air seal to a borehole formed by the downhole hammer drill in use.

10. A downhole hammer according to claim 1, wherein said upper air passages each open from a spline in the region of the bit head via an exhaust air passage formed in said bit shank adjacent said bit head.

11. A downhole hammer drill according to claim 10, wherein spline-borne exhaust air is also directed from the exhaust air passage through the bit head by at least one lower air passage.

* * * * *